United States Patent [19]

Koyanagi

[11] Patent Number: 4,952,762

[45] Date of Patent: Aug. 28, 1990

[54] KEYBOARD SWITCH

[75] Inventor: Masaharu Koyanagi, Mobara, Japan

[73] Assignee: Futaba Denshi Kogyo Kabushiki Kaisha, Mobara, Japan

[21] Appl. No.: 334,569

[22] Filed: Apr. 7, 1989

[30] Foreign Application Priority Data

Apr. 8, 1988 [JP] Japan ..... 63-046829[U]

[51] Int. Cl.[5] ..... H01H 1/10

[52] U.S. Cl. ..... 200/517; 200/341; 200/345; 200/520; 200/532

[58] Field of Search ..... 200/517, 532, 341, 345, 200/520

[56] References Cited

U.S. PATENT DOCUMENTS

| | | | |
|---|---|---|---|
| 3,909,564 | 9/1975 | Scheingold et al. | 200/517 |
| 4,341,934 | 7/1982 | Muller | 200/517 |
| 4,463,237 | 7/1984 | Kim | 200/341 |
| 4,492,838 | 1/1985 | Fukukura | 200/517 |
| 4,496,803 | 1/1985 | Smith | 200/532 |
| 4,529,849 | 7/1985 | Kamei et al. | 200/517 |

FOREIGN PATENT DOCUMENTS

| | | | |
|---|---|---|---|
| 2245751 | 5/1973 | Fed. Rep. of Germany | 200/532 |

*Primary Examiner*—Henry J. Recla
*Assistant Examiner*—Kath Kupferschmid
*Attorney, Agent, or Firm*—Oblon, Spivak, McClelland, Maier & Neustadt

[57] ABSTRACT

A keyboard switch capable of minimizing the number of parts to reduce manufacturing costs and giving an operator a light touch during its operation. The keyboard switch includes an actuator arranged in a frame for pressing a membrane switch. The actuator includes a key stem, a pressing member for forcedly pressing the membrane switch, a pair of leaf springs for forcedly pushing up the key stem. The key stem, pressing member and leaf spring means are integrally formed and joined together by a base member.

8 Claims, 3 Drawing Sheets

KEYBOARD SWITCH

BACKGROUND OF THE INVENTION

1. Field of the Invention

This invention relates to a keyboard switch for use in a data entry system for a computer, a typewriter, a word processor and the like, and more particularly to an improvement in an actuator or the keyboard switch which acts upon a membrane switch by vertical movement of a key stem of the switch.

2. Description of the Prior Art

FIGS. 3A and 3B illustrate a conventional keyboard switch. The keyboard switch includes a frame 1 which serves as a housing and a stationary side of the switch. The frame 1 is formed at an upper surface thereof with a circular aperture 1*a* through which a cylindrical key stem is inserted so that it may move vertically. A key top 3 is mounted on an upper end of the key stem 2, while a pressing member 4 is fixed to a lower end of the key stem Z. The pressing member 4, as shown in FIGS. 4(*a*) and 4(*b*), is formed into a substantially annular shape and includes a rear section 4*a* which is integral with a side 2*a* of the key stem 2 to be connected in a cantilever fashion by means of a neck portion 5. The pressing member 4 also includes a front section 4*b* having a pressing projection 6 on the rear surface thereof. The pressing member 4 is resilient in the vertical direction. The frame 1 includes a cavity in which a sheet-like contact member (hereinafter referred to as "membrane switch") 7 is arranged on a substrate 8 of the frame 1. The membrane switch 7 is formed of two films 9 and 10 having an upper contact 9*a* and a lower contact 10*a*, respectively, and arranged in a manner to be opposite to each other with a spacer 11 therebetween. The contacts 9*a* and 10*a* are positioned right under the pressing projection 6 provided at the pressing member 4 of the key stem 2. Between the lower end of the key stem 2 and the sheet 9, a return spring 12 is arranged to bias the key stem 2 upwardly.

In the conventional keyboard switch described above, when the key top 3 is depressed with a finger, the key stem 2 slides into the frame 1 while compressing the return spring 12 to cause both contacts 9*a* and 10*a* of the membrane switch 7 to contact with each other by means of the pressing projection 6, thereby to close the switch.

When assembling the keyboard switch, the key stem 2 is inserted through the aperture 1*a* from the lower side of the frame 1 and the return spring 12 is put on the lower end of the key stem 2 which projects in the frame 1. The return spring 12 is then held by the substrate 8 on which the membrane switch 7 is fixed, while aligning the substrate 8 with the frame 1. In this condition, the return spring 12 is held at a somewhat compressed state, because it is to impart returning force to the key stem 2. The return spring 12 extends beyond the lower surface of the frame before the membrane switch 7 is put on the frame 1, and is liable to deform its shape during the assembling, because it is made independent from the key stem 2, which makes it difficult to fix the membrane switch 7 and substrate 8 with respect to the frame 1 while aligning them with the frame 1. Furthermore, the conventional keyboard switch not only has the drawback associated with the assembling of the switch resulted from the return spring 12 and key stem 2 which are made independent from each other, but also it is high in manufacturing costs, because there are a number of parts to be assembled.

In addition, the conventional keyboard switch causes the key stem 2 to strike at its lower end directly against the membrane switch 7 on the stationary side of the frame 1 when the key stem 2 is depressed. The repeating operation of such a keyboard switch sometimes damages fingers of a keyboard operator by shock due to the strike, and also generates noise. The noise is generated due to strike of the key stem 2 against the frame as well when the key stem 2 is returned to the original position.

SUMMARY OF THE INVENTION

The present invention has been made in view of the foregoing disadvantages of the prior art.

Accordingly, it is an object of the present invention to provide a keyboard switch which is capable of reducing the number of parts to be assembled, thereby to reduce the manufacturing costs.

It is another object of the present invention to provide a keyboard switch which is operated with a light touch without increasing the number of parts to be assembled.

In accordance with the present invention, there is provided a keyboard switch. The keyboard switch includes a membrane switch arranged on a substrate and an actuator for pressing the membrane switch. The membrane switch and the actuator are arranged in a frame. The actuator is formed of a key stem provided at an upper portion thereof with a key top, a pressing member for forcedly pressing the membrane switch, spring means for forcedly pushing up the actuator, and a base member for joining the key stem, pressing member and spring means together. The resulting actuator is made into an integral structure.

In the keyboard switch of the present invention explained hereinabove, depression of the key stem by touching the key top causes the spring means to be deflected to actuate the pressing member, to thereby close the membrane switch. When the key stem is depressed further, the spring means is further deflected to contact the spring means with a stationary side of the keyboard switch. This leads to an increase in repulsion force of the spring means against the load of depression, thereby to absorb shock generated when the lower end of the key stem strikes against the stationary side of the keyboard switch. When the spring means is released from the depression, the key stem is upwardly returned to the original position due to the restoring force of the spring means. Then, the pressing member is separated from the membrane switch and opens the switch.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout, wherein:

FIG. 2(*b*) is a perspective view of the key stem shown in FIG. 2(*a*);

FIG. 2(c) is a further embodiment of the key stem;

FIG. 4(*a*) is a perspective view of the key stem shown in FIG. 4(*b*).

DETAILED DESCRIPTION OF THE PREFERRED EMBODIMENT

Now, a keyboard switch according to the present invention will be described hereinafter with reference to FIGS. 1(*a*) to 2(*c*).

Figure 1:
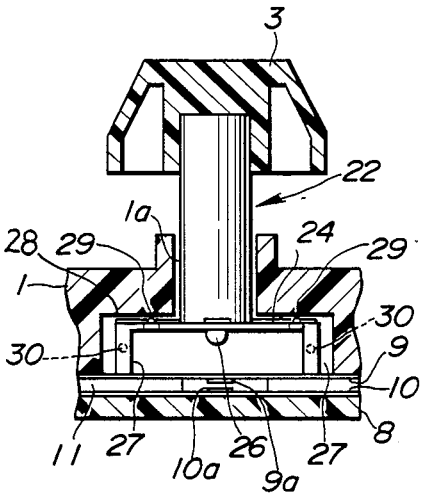
FIGS. 1(*a*) and 1(*b*) each are a vertical sectional view showing an embodiment of a keyboard switch according to the present invention.
Figure 1:
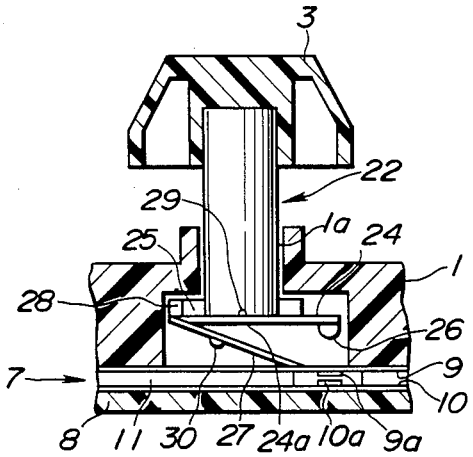

FIGS. 1(*a*) and 1(*b*) show an embodiment of a keyboard switch according to the present invention. The feature of the keyboard switch of the present invention resides in a configuration and a structure of a key stem. Accordingly, the following description will be mainly made in connection with the key stem.

Figure 2:
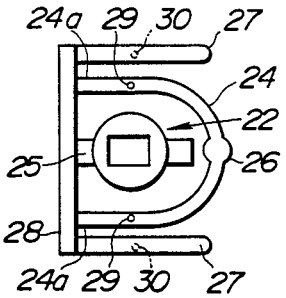
FIG. 2(*a*) is a plan view showing a key stem employed in the keyboard switch shown in FIGS. 1(*a*) and 1(*b*)
Figure 2:
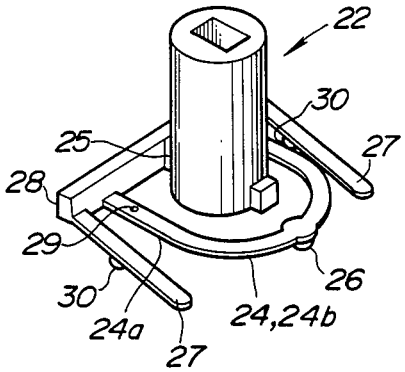
Figure 2:
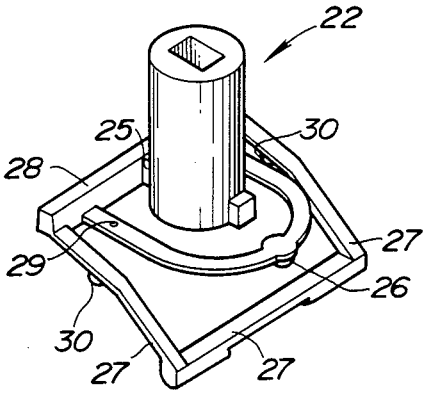

An actuator of the keyboard switch of the embodiment shown in FIGS. 1 and 2 includes a cylindrical key stem 22, a rigid base member 28 horizontally connected to the lower end of the key stem 22 by means of a neck portion 25. The actuator is integrally made of a synthetic resin. It is to be understood that the base member 28 may be formed together with the key stem 22 without providing the neck portion 25. The actuator further includes a vertically elastic pressing member 24 and a pair of vertically elastic leaf springs 27 which are connected to the base member 28. The members 24 and 27 may be formed integral with the base member 28. Alternatively, they may be formed separate from the member 28. In the illustrated embodiment, the members 24 and 27 are formed integral with the base member 28 which is connected to the lower end of the key stem 22 by means of the neck portion 25. A thickness of each of the neck portion 25 and base member 28 is so determined that they may exhibit rigidity. The pressing member 24 is formed into a substantially U-shape and integral with the base member 28 and horizontally arranged so as to surround the key stem 22. The pressing member 24 has a thickness which is sufficient enough to have the pressing member 24 exhibit vertical elasticity. The pressing member 24 has a front portion 24*b* which is provided with a projection 26 on the lower surface thereof. In addition, the pressing member 24 is provided with a pair of arms 24*a* formed integral with the base member 28. The arms 24*a* each are provided on an upper surface thereof with projections 29 for extinguishing noises. These projections 29 may be provided on an upper surface of the rear portion of each of the leaf springs 27.

The leaf springs 27 are integrally formed on both ends of an outer side of the base member 28 on which the pressing member 24 is formed. The leaf springs 27 each are of the cantilever type and, as shown in FIG. 1(*b*), arranged so as to extend from the base member 28 in the obliquely downward direction at a predetermined angle with respect to the pressing member 24 and in a side-by-side relationship to the pressing member. Each of the leaf springs 27 is provided on a substantially central portion of the lower surface thereof with a projection 30. In an alternative embodiment, the leaf springs 27, as shown in FIG. 2(*c*), may be connected at their distal ends to each other so as to form a substantially U-shape.

The key stem 22 is interposedly arranged between a frame 1 and an assembly formed of a membrane switch 7 and a substrate 8 fixed on the frame 1 so that it may be vertically movable within the frame.

Figure 3:
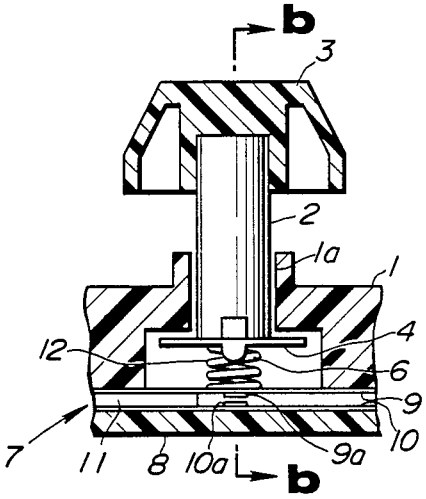
FIG. 3 (a) PRIOR ART
FIGS. 3(*a*) and 3(*b*) are sectional views similar to FIGS. 1(*a*) and 1(*b*), respectively, each of which shows a conventional keyboard switch.
Figure 3:
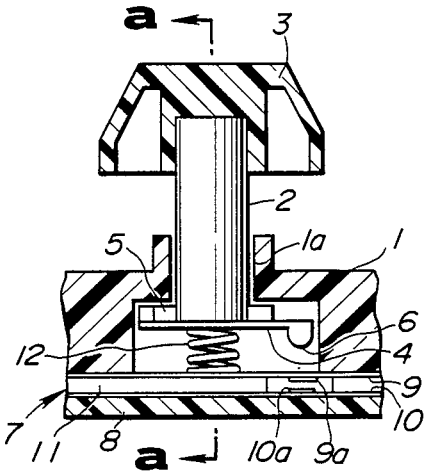
FIG. 3 (b) PRIOR ART
Figure 4:
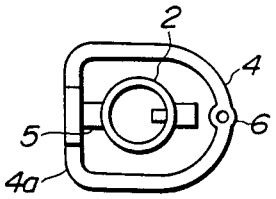
FIG. 4 (a) PRIOR ART
FIG. 4(*a*) is a plan view showing a key stem employed in the conventional keyboard switch shown in FIGS. 3(*a*) and 3(*b*)
Figure 4:
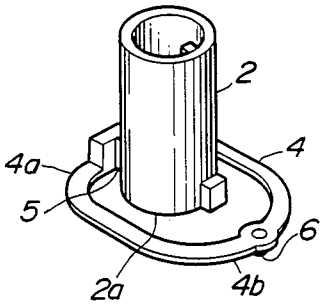
FIG. 4 (b) PRIOR ART

The remaining parts of the keyboard switch of the embodiment shown in FIGS. 1 and 2 is constructed substantially in the same manner as the conventional keyboard switch explained with reference to FIGS. 3(*a*) to 4(*b*).

Now, the manner of operation of the keyboard switch according to the present invention will be described hereinafter with reference to FIGS. 1(*a*) to 2(*c*).

When a key top 3 is touched to depress the key stem 22, the leaf springs 27 are deflected to make contacts 9*a* and 10*a* of the membrane switch 7 contact by the projection 26 of the pressing member 24 provided at the key stem 22, thereby to close the switch. The further depression of the key stem 22 causes the leaf springs 27 to be further deflected, and the projections 30 of the leaf springs 27 are contacted with an upper membrane sheet 9. As a result, repulsion force of the leaf springs 27 against the load of depression is increased, which absorbs shock and noise generated when the lower end of the key stem 22 strikes against the upper membrane sheet 9. When the key stem 22 is released from the depression, the restoring force of the leaf springs 27 causes the key stem 22 to be gradually returned to the original position releasing projections 30 of the leaf springs 27 from the upper membrane sheet 9 and then the pushing projection 26 of the pressing member 24 from the sheet 9, thereby to separate the contacts 9*a* and 10*a* of the membrane switch 7 from each other so as to open the switch. When the key stem 22 approaches the original position, the projections 29 provided on the pressing member 24 of the key stem 22 contact to an inner surface of the frame 1, which is the stationary side of the keyboard switch, before the key stem 22 contacts to the inner surface of the frame, thereby minimizing shock and noise due to striking of the key stem 22 to the frame 1.

In the keyboard switch explained hereinabove, the key stem, base member, pressing member and leaf springs which are the component parts of the actuator of the keyboard switch are integrally formed of the same synthetic resin material. It is to be understood that the keyboard switch may be constructed in such a manner that the rigid base member and the key stem are integrally formed of a synthetic resin material, while the pressing member and the leaf springs are made of an elastic synthetic resin or metal material separate from the key stem and the base member. The base member is provided with mounting holes in which the pressing member and the leaf springs are fitted, and the pressing member and the leaf springs are fittedly bonded through the mounting holes to the base member, thereby to form the actuator in an integral structure.

Also, the above explanation of the invention has been made in connection with the keyboard switch of a full stroke using the membrane switch as a contact. However, it will be readily understood that the present invention is of course applicable to a frame-integrated keyboard switch as well as a keyboard switch of a single structure.

As is apparent from the explanation hereinabove, the keyboard switch of the present invention is so contructed that the key stem, base member, return leaf springs and pressing member are made into an integral structure. Such a structure eliminates a return spring used in the conventional keyboard switch which is separate from a key stem. Accordingly, the component parts of the keyboard switch can be minimized, thereby reducing the manufacturing cost. Also, the touch and stroke responded to the fingers of the keyboard switch operator can be improved by merely varying a thickness of the leaf spring, its width, its mounting angle or the like without increasing the number of the component parts.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A keyboard switch comprising:

a substrate;

a membrane switch arranged on said substrate;

an actuator for pressing said membrane switch;

a frame in which said membrane switch and actuator are arranged;

said actuator including a key stem provided at an upper portion thereof with a key top, a pressing member for forcedly pressing said membrane switch, spring means for forcedly pushing up said actuator, and a base member for joining said key stem, pressing member and spring means together, said actuator being made into an integral structure, wherein said pressing member comprises a pair of arms having an upper surface on which projections are formed, the height of said projections being such that said projections contact an inner surface of said frame before said pressing member contacts said inner surface of said frame, whereby noise when said pressing member comes into contact with said inner surface of said frame when said actuator is pushed up by said spring means is extinguished.

2. The keyboard switch as defined in claim 1, wherein said key stem and base member are rigid synthetic resin, and said pressing member and spring means are elastic synthetic resin.

3. The keyboard switch as defined in claim 1, wherein said key stem is cylindrical in shape and fitted on its upper portion thereof with said key top;

said base member extends from the lower end portion of said key stem in the horizontal direction;

said pressing member and extends from said base member surrounds said key stem; and said spring means extends in a side-by-side relationship to said pressing member and in the obliquely downward direction at a predetermined angle from said base member.

4. The keyboard switch as defined in claim 1, wherein said actuator is integrally formed of a plastic material.

5. The keyboard switch as defined in claim 1, wherein said pressing member is provided with a projection on the lower surface thereof for pressing said membrane switch.

6. The keyboard switch as defined in claim 1, wherein said spring means is provided with projections on the lower surface thereof for contacting said membrane switch.

7. The keyboard switch as defined in claim 1, wherein said arms are connected to each other at their distal ends thereof.

8. The keyboard switch as defined in claim 1, wherein said spring means is a leaf spring.

* * * * *